US005817390A

United States Patent [19]

Johnson

[11] Patent Number: 5,817,390

[45] Date of Patent: Oct. 6, 1998

[54] PILE WEATHER STRIPPING HAVING INTERNAL AND EXTERNAL FINS

[75] Inventor: Larry E. Johnson, Victor, N.Y.

[73] Assignee: Ultrafab, Inc., Farmington, N.Y.

[21] Appl. No.: 778,833

[22] Filed: Jan. 6, 1997

Related U.S. Application Data

[63] Continuation of Ser. No. 492,553, Jun. 20, 1995, abandoned.

[51] Int. Cl.[6] ..... D04H 11/00

[52] U.S. Cl. ..... 428/85; 428/92; 428/95; 428/122; 49/489.1; 49/490.1

[58] Field of Search ..... 428/85, 89, 92, 428/95, 122; 49/475.1, 489.1, 490.1

[56] References Cited

U.S. PATENT DOCUMENTS

| | | | |
|---|---|---|---|
| 3,836,421 | 9/1974 | Terry et al. | 161/63 |
| 4,078,106 | 3/1978 | Lind | 428/34 |
| 4,148,953 | 4/1979 | Horton | 428/85 |
| 4,198,453 | 4/1980 | Olson | 49/489.1 |
| 4,302,494 | 11/1981 | Horton | 428/95 |
| 4,305,984 | 12/1981 | Boyce | 428/85 |
| 4,352,845 | 10/1982 | Miska | 428/88 |
| 4,458,450 | 7/1984 | Young et al. | 49/489 |
| 4,637,948 | 1/1987 | Evans et al. | 428/89 |
| 4,699,818 | 10/1987 | Evans | 428/85 |
| 5,060,422 | 10/1991 | Horton | 49/489 |
| 5,093,181 | 3/1992 | Sanchez | 428/167 |
| 5,338,382 | 8/1994 | Johnson et al. | 156/72 |

*Primary Examiner*—Alexander Thomas
*Attorney, Agent, or Firm*—M. Lukacher; K. Lukacher

[57] ABSTRACT

Pile weatherstripping having rows of pile and longitudinal fins both within and external to the rows of pile. The heights of the fins with respect to the height of the pile may be independently varied and controlled. A travelling endless band receives a pair of first webs providing internal fins on opposite sides of the band. The first webs are indexed to the edges of the band, which defines the heights of the fins. Each web may be independently indexed. Alignment of the webs on the band is provided either by an aligning fixture or by coining the webs to provide lines of indentations which index the webs at the edges of the band. The yarn which forms the pile is wound around the first webs. Second webs providing the external fins are indexed through the yarn and first webs to the edges of the band and are also aligned by a second aligning fixture or by coining. Backing strips are attached, as by ultrasonic welding, along the edges of the band. Then the yarn is slit without cutting into the webs. Hold-down wires may be used overlying the webs on the surfaces of the bands and below the yarn. These wires may be lifted during slitting to afford clearance of the knives from the band. After slitting there is provided a pair of weatherstrips having rows of pile provided by the slit yarn, at least one internal fin between the rows of pile, and at least one fin external to the rows of pile, the height of each fin being precisely and independently controllable with respect to the height of the pile.

11 Claims, 4 Drawing Sheets

PILE WEATHER STRIPPING HAVING INTERNAL AND EXTERNAL FINS

This is a continuation of application Ser. No. 08/492,553 filed Jun. 20, 1995 now abandoned.

The present invention relates to pile weatherstripping, more particularly to pile weatherstripping having fins, the heights of which are precisely located with respect to the height of the pile, and most particularly to such weatherstrips having fins both between and outside of rows of piles.

Apparatus and method of the invention may be used to provide pile weatherstripping having fins, the height of which with respect to the height of the pile may be adjusted to accommodate different specifications for air infiltration through weatherstripping, and also to enable pile weatherstripping having a plurality of fins both between and outside of rows of piles to be produced at high speed with efficient use of materials, such as polypropylene which provides the fins thereof, thereby affording economies of cost in the fabrication process.

Known pile weatherstripping can be manufactured at high speed and at low cost by winding yarn on an endless travelling band, or mandrel, utilizing the techniques described in U.S. Pat. Nos. 4,148,953 issued Apr. 10, 1979 to Robert C. Horton; and 4,302,494 issued Nov. 24, 1981, also to Robert C. Horton; and 5,338,382 issued Aug. 16, 1994 to Larry E. Johnson et al.

In the Johnson patent, which is hereby incorporated herein by reference, a method is disclosed for making pile weatherstripping having one or more internal fins by fabricating a pair of weatherstrips each having adjacent rows of pile attached to a backing strip, and with at least one of the weatherstrips having one or more fins between its adjacent rows of pile, the fin or fins being of height in precisely the desired relationship to the height of the pile. As used herein, "internal" refers to a fin or fins having pile adjacent to both surfaces thereof, and "external" refers to a fin or fins having pile adjacent to only one surface thereof.

The internal fin is provided by a web which is fed onto a side of a travelling band. The web is aligned so that one of its longitudinal edges is parallel to and a predetermined distance from one of the longitudinal edges of the band. The other of the longitudinal edges of the web overhangs the band. This alignment may be provided by a guide which forms a channel through which the web is advanced as it is placed upon the side of the band. Alternatively, the web may be formed with a longitudinal indentation, as by coining. The longitudinal indentation is precisely located with respect to the edge of the web which forms the height of the fin. This indentation provides means for indexing the web on the band. Such indexing occurs when the web is wrapped around the longitudinal edge of the band, either with a web guide or upon winding of yarn around the web and the band. The backing strips are then attached to the yarn and the band, as by ultrasonic welding which is described in the above-referenced Horton patents. The yarn is then slit, but without cutting the web, to yield two substantially identical pile weatherstrips, each having at least one internal fin between the rows of piles. Slitting may be accomplished by inserting hold-down wires over the band and the web before winding of the yarn and then lifting the wires to separate the yarn from the web during slitting. The slit yarn forms the piles, and the web provides the fin which extends above the backing strip to a height which is predetermined by the height of the prefabricated, independent web. A plurality of fins may be placed on the band in overlying relationship if desired to provide a multiple layer internal fin structure between the rows of piles.

Pile weatherstripping made in accordance with the above technique is limited to having only internal fins. This limits the extent to which the weatherstrip can block the infiltration of air through a weatherstripped closure. Also, the pile is unsupported at its outer edges and can be bent over or deformed so that it may not seal properly on successive closings.

It is a principal object of the present invention to provide an improved pile weatherstripping having fins both internal and external to the piles.

It is a further object of the present invention to provide an improved pile weatherstripping having fins external to the piles.

It is a still further object of the subject invention to provide an improved method of making pile weatherstripping wherein the pile weatherstripping can have both internal and external fins.

It is a still further object of the present invention to provide an improved method of making pile weatherstripping having internal and external fins which enables the fins to be positioned with the height thereof in precise relationship to the height of the piles of the weatherstripping.

Briefly described, pile weatherstripping in accordance with the invention includes a plurality of longitudinal rows of piles, at least one longitudinal internal fin, and preferably two longitudinal fins, formed from a web and disposed external to the piles, a backing strip fused or adhered to the external fin and, by extension, to the piles, and optionally at least one fin internal to the piles. The fins may be of any desired height relative to the height of the piles, and the height of each of any individual fin may be selected and controlled by folding or scoring of the web forming the fin prior to or during assembly as disclosed in the above-referenced patent to Johnson et al.

Weatherstripping as disclosed in the patent to Johnson et al. has an internal fin provided by a folded or coined first web which is placed around an edge of the endless band or mandrel prior to wrapping of the band with yarn. Weatherstripping in accordance with the present invention includes those steps, but in addition, and prior to adding a backing strip and slitting the yarns to form the rows of pile, a second folded or coined web is placed around the same edge of the band and over the yarns. The second web is also preferably pre-formed according to coining or folding techniques disclosed in the Johnson et al. patent prior to being introduced to the weatherstripping assembly machine, thus assuring that the external fin will be of a predetermined, desired height. To make two weatherstrips, each having internal and external fins, two additional webs are similarly pre-formed and incorporated along the opposite edge of the band both under and over the yarns.

In a preferred apparatus of the invention, the apparatus disclosed in the Johnson et al. patent is augmented with a folding mechanism to form the second web into a U-shape, preferably by longitudinal coining of the web prior to folding to ensure the widthwise location of folding of the web and thus the desired height of the fin. If it is desired to have an external fin the same height as the cut pile, or less, the pile may be slit along or away from the predetermined edge location of the external fin. If the external fin must be higher than the height of the cut pile, apparatus must be included, such as a simple shoe guide, to lift the external fin and temporarily fold it out of the way during slitting of the yarns.

Since the apparatus of the invention can make simultaneously two independent pile weatherstrips, one along each edge of the endless band, each such weatherstrip may have any combination of internal and external fins or no fins at all.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which:

FIGS. 7–10 are a sequence of sectional views perpendicular to the band showing the weatherstrip in successive stages in the process of fabrication and the final product (FIG. 10); FIG. 10 being a cross-sectional view of two identical weatherstrips in accordance with the invention provided by the slitting shown in FIG. 9, each such weatherstrip having one internal fin and two external fins and being identical with the weatherstrip shown in FIG. 2.

Figure 6:
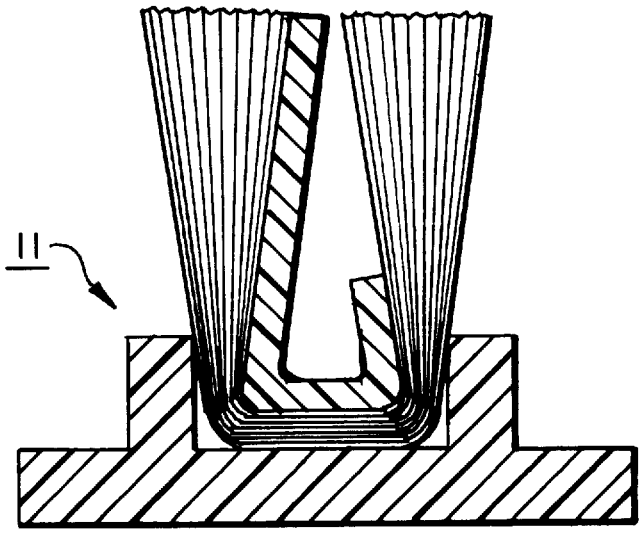
FIG. 6 is an elevational cross-sectional view of an internal-fin weatherstrip as disclosed as FIG. 16 by Johnson et al. in U.S. Pat. No. 5,338,382 incorporated herein.

Reference should be had to the above-incorporated Johnson et al. patent for the design of a multi-station machine which fabricates pile weatherstrips having an internal fin or fins by winding of yarn around an endless band or mandrel having a first folded web placed along at least one edge thereof, the web preferably being pre-formed by coining or folding or both prior to introduction of the web onto the band to predetermine the height of the resulting internal fin as described hereinabove. A pile weatherstrip 11 in accordance with the patent of Johnson et al. is shown therein as FIG. 16 and herein as FIG. 6. Although previously patented and not within the scope of the present invention, it is a variant in the homologous series of pile weatherstrips having rows of cut pile attached to a backing strip. Another variant, not shown, is a pile weatherstrip having no internal or external fins, as patented by Horton in U.S. Pat. No. 4,302,494 (FIG. 16 of this patent).

Figure 1:
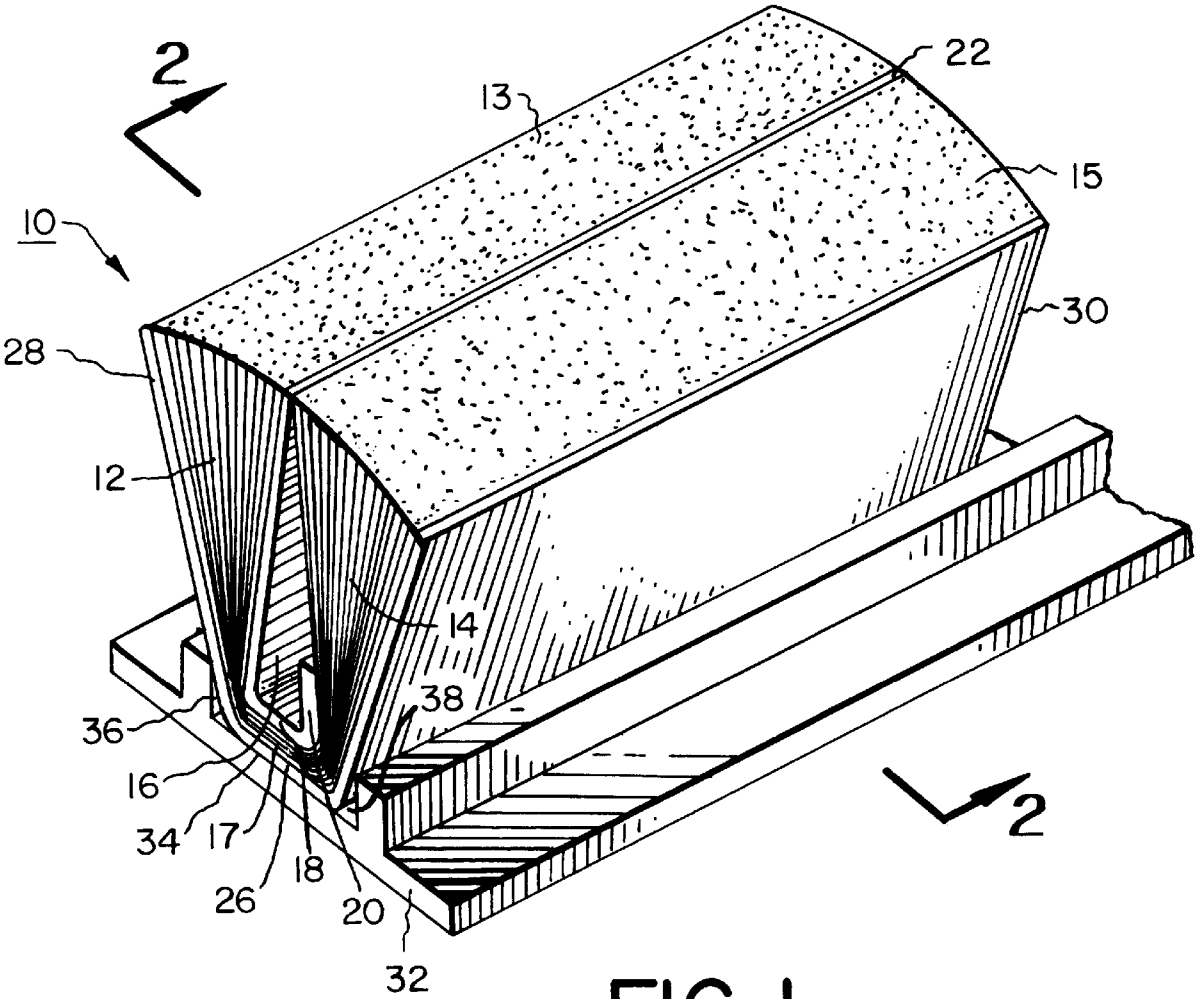
FIG. 1 is an isometric view of an end portion of a pile weatherstrip in accordance with the invention, showing one internal fin and two external fins.
Figure 2:
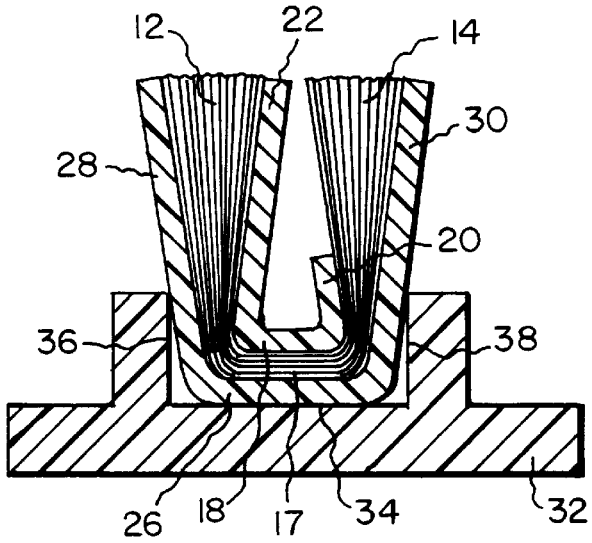
FIG. 2 is an elevational cross-sectional view taken along line 2—2 in FIG. 1.

Referring to FIGS. 1 and 2, a pile weatherstrip assembly 10 having internal and external fins in accordance with the invention includes first and second rows of cut pile 12 and 14, respectively, with plush surfaces 13 and 15, respectively, a first web 16 folded to provide an attachment portion 18, a return 20, and an internal fin 22 which is substantially the same height as the pile. Pile rows 12 and 14 are formed from opposite end portions of yarn strands which are folded around web 16 to provide attachment portion 17. A second web 24, folded into a substantially symmetrical U-shape, is disposed around the folded yarns to provide an attachment portion 26 and first and second external fins 28 and 30, respectively, which are also substantially equal in height to the pile. Assembly 10 is thus a triple-fin pile weatherstrip assembly. A backing strip 32 has a channel 34 defined by sides 36 and 38, which channel retains the two webs and the pile yarns therebetween. Preferably, all the elements described are formed from polyolefin polymer, for example, polypropylene, which is weldable ultrasonically by known techniques. Assembly 10 is held together preferably by a continuous ultrasonic weld along channel 34 at attachment portions 17, 18, and 26.

Figure 5:
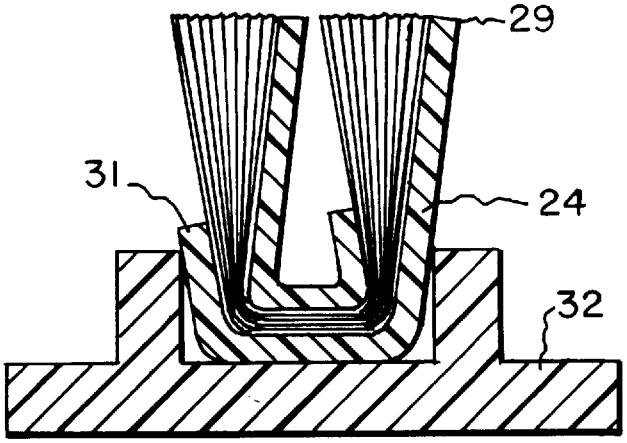
FIG. 5 is an elevational cross-sectional view of a second embodiment of a pile weatherstrip in accordance with the invention having one internal fin and one external fin.

Within the scope of the invention but not limiting thereto, each of fins 22, 28, and 30 may be of greater or lesser height than the pile. Pile rows 12 and 14 may be of different heights than the fins or each other. Return 20 may be provided of sufficient height to constitute a second internal fin. Web 16 may be omitted entirely, providing thereby a pile weatherstrip having only external fins formed from a web. Second web 24 may be folded assymetrically, like web 16, to provide only one external fin 29 and an external return 31, as shown in FIG. 5.

Figure 3:
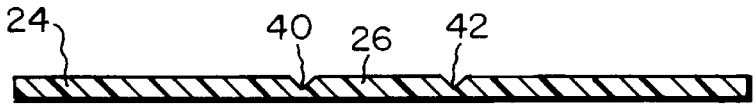
FIG. 3 is a cross-sectional view of the coined web used to provide the two external fins shown in FIGS. 1 and 2, prior to being folded along the coinings.
Figure 4:
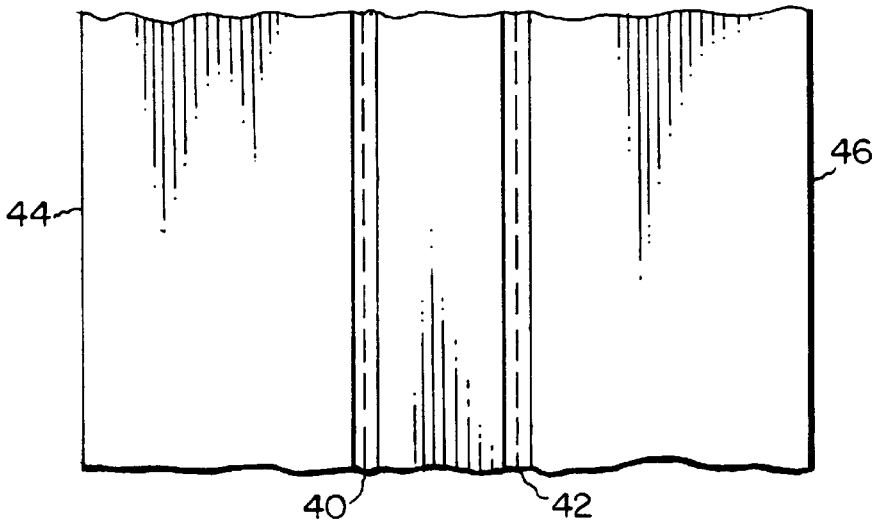
FIG. 4 is a plan view of a portion of the coined web shown in FIGS. 1–3, showing two areas of longitudinal coining to predetermine the height of the fin after folding and incorporation into the weatherstrip.

The height of the external fins can be predetermined in the manner disclosed for predetermining the height of internal fins in the Johnson et al. patent. Preferably, web 24 to be formed to provide fins 28 and 30 is subjected to coining (substantially as shown in Johnson's FIG. 1) to provide first and second indentations 40 and 42, respectively, which preferably are located at a fixed and specified distance from the respective first and second edges 44 and 46 of web 24, as shown in FIGS. 3 and 4.

Figure 7:
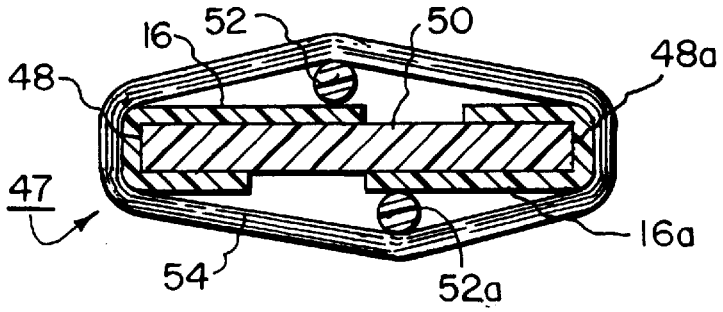
FIG. 7 is an elevational cross-sectional view of an intermediate assembly in formation of pile weatherstripping on an endless band in accordance with the invention, corresponding to FIG. 13 in the patent to Johnson et al.

Weatherstrips in accordance with the invention can be fabricated in pairs using techniques and apparatus disclosed by Johnson et al. as modified to allow addition of external fins to the weatherstrip assembly. In FIG. 7, an intermediate structure 47 is shown. First and third webs 16 and 16*a* have been coined, folded, and placed along edges 48 and 48*a* respectively of band 50. Hold-down wires 52 and 52*a* are disposed on webs 16 and 16*a* and serve to bridge endless yarn 54 away from band 50 as the yarn is wrapped helically and continuously along the band. Preferably wires 52 and 52*a* are not opposed but are slightly offset one from the other to permit slitting of the yarn over the midpoint of the band in a later step.

Figure 8:
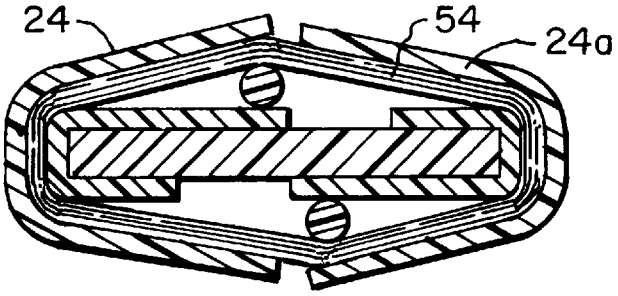
Figure 9:
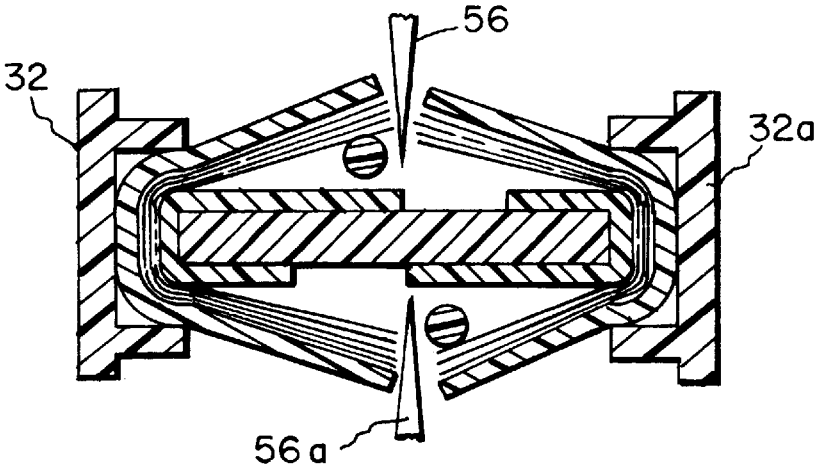
Figure 10:
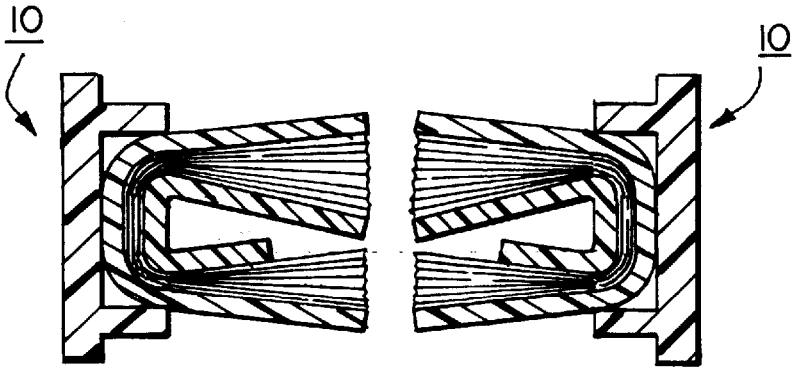

Second and fourth webs 24 and 24*a* are coined and folded as described for the first and third webs and are disposed around band edges 48 and 48*a* and yarn 54, as shown in FIG. 8, for example, by being guided through a pair of stationary guides or channels (not shown) adjacent to the edges of the band. Backing strips 32 and 32*a* are then placed over the second and fourth webs, and the assembly is joined, preferably by the known technique of ultrasonic welding, along each edge of the endless band. In FIG. 9, the joined assembly is shown being slit. The hold-down wires 52 and 52*a* are raised to lift the yarns away from the band thereby providing clearance for the slitting knives 56 and 56*a*. (Preferably, the knives slit only the yarns, although the external fins could also be cut to the same height as the pile in this step if so desired.) When the yarns have been severed as in FIG. 9, the weatherstrips can be removed from the band, resulting in two identical weatherstrips having one internal fin and two external fins, as shown in FIG. 10.

The inventive method illustrated can make pile weatherstripping having external fins only as high as the pile. If higher external fins are desired, wider web 24 is used, and the external fins in the assembly prior to slitting will overlap (not shown). To avoid slitting the higher fins when slitting the pile, these external fins must be folded out of the way, as by means of a guide or shoe in the apparatus, immediately before the slitting step, and allowed to resume their intended configuration thereafter.

From the foregoing description it will be apparent that there has been provided improved finned pile weatherstripping, wherein external fins pre-formed from webs can be added to a pile weatherstripping assembly. Variations and modifications of the herein described pile weatherstripping, in accordance with the invention, will undoubtedly suggest themselves to those skilled in this art. Accordingly, the foregoing description should be taken as illustrative and not in a limiting sense.

What is claimed is:

1. A pile weatherstrip comprising:

(a) a plurality of rows of pile;

(b) at least one internal air infiltration control fin between said rows of pile;

(c) at least one external air infiltration control fin external to said rows of pile; and (d) a backing strip separate, until assembled from said rows and from said external fin and said internal fin and on which said rows and fins are disposed in assembled relationship.

2. A pile weatherstrip in accordance with claim 1 wherein all components are formed from polypropylene.

3. A pile weatherstrip comprising:

(a) a plurality of rows of pile;

(b) a least one internal air infiltration control fin between said rows of pile;

(c) a least one external air infiltration control fin external to said rows of pile;

(d) a backing strip separate, until assembled, from said rows and from said external fin and said internal fin on which said rows and fins are disposed in assembled relationship;

(e) a second air infiltration control fin external to said rows of pile and opposite to said first external fin, said first and second external fin being of a height generally commensurate with the heights of said pile.

4. A pile weatherstrip comprising:

(a) a plurality of rows of pile;

(b) at least one internal air infiltration control fin between said rows of pile;

(c) at least one external air infiltration control fin external to said rows of pile;

(d) a backing strip separate, until assembled, from said rows and from said external fin and said internal fin and on which said rows and fin are disposed in assembled relationship; and (e) said fins being formed from webs which are preformed to provide said internal and external fins of desired, predetermined height.

5. A pile weatherstrip in accordance with claim 4 wherein said fins and said pile are the same height.

6. A pile weatherstrip in accordance with claim 4 wherein said fins and said pile are of differing heights.

7. A pile weatherstrip comprising:

(a) a plurality of rows of pile;

(b) at least one internal air infiltration control fin between said rows of pile;

(c) at least one external air infiltration control fin external to said rows of pile;

(d) a backing strip on which said rows and fins are disposed; and (e) said fins and pile extending above said backing strip to heights, the magnitudes of which are generally commensurate with each other.

8. A pile weatherstrip in accordance with claim 7 further comprising a second air infiltration control fin external to said rows of pile and opposite to said first external fin and separate from said rows and said backing strip and disposed in assembled relationship with said rows said first external fin and said internal fin on said backing strip.

9. A pile weatherstrip in accordance with claim 7 wherein said fins are formed from webs which are preformed to provide said heights of said fins of a desired predetermined height.

10. A pile weatherstrip in accordance with claim 7 wherein said backing strip, pile rows and fins are formed from polypropylene.

11. A pile weatherstrip comprising:

(a) a plurality of rows of pile;

(b) at least one air infiltration control fin disposed externally of said rows of pile and at least one other air infiltration control fin disposed internally of said rows of pile, said fins being formed from webs separate from the rows of pile; and (c) said pile, rows and fins being generally commensurate in height with each other and being disposed in assembled relationship.

* * * * *